US005401003A

United States Patent [19]

Aizatulov et al.

[11] Patent Number: 5,401,003

[45] Date of Patent: Mar. 28, 1995

[54] METHOD AND APPARATUS FOR FLAME GUNNING

[75] Inventors: Rafik Aizatulov; Grigori Galperine, both of Novokuznetsk, Russian Federation; Gregory M. Gitman, Atlanta; Iakov Grenader, Norcross, both of Ga.; Boris Kustov, Novokuznetsk, Russian Federation; Anatoly M. Sizov, St. Petersburg, Russian Federation; Stanislav I. Zhigach, St. Petersburg, Russian Federation

[73] Assignee: ZapTech Corporation, Norcross, Ga.

[21] Appl. No.: 55,423

[22] Filed: Apr. 29, 1993

[51] Int. Cl.[6] ..... F27D 1/16

[52] U.S. Cl. ..... 266/44; 266/280; 264/30

[58] Field of Search ..... 266/44, 280, 281; 264/30

[56] References Cited

U.S. PATENT DOCUMENTS 4,487,397 12/1984 Antonov et al. ..... 266/44

FOREIGN PATENT DOCUMENTS 0193429 9/1986 European Pat. Off. ..... 266/281
0223277 12/1984 Japan ..... 264/30
676579 7/1979 U.S.S.R. .
935497 6/1982 U.S.S.R. .
0973626 11/1982 U.S.S.R. ..... 264/30
1476286 4/1989 U.S.S.R. ..... 264/30

OTHER PUBLICATIONS

O. N. Chemeris, et al., "The Utilization of Slagforming Materials for BOF Flame Gunning"; Refractories No. 3, Dec. 1982, ISSN 03697290.

*Primary Examiner*—Scott Kastler
*Attorney, Agent, or Firm*—Needle & Rosenberg

[57] ABSTRACT

A method of applying a hot composite on top of the refractory lining of steel making and processing vessels is disclosed. The composite may be applied to the refractory wall in more than one layer, including a dense intermediate layer for adhesion, and a less dense layer on top that is designed to be consumed as a slag-forming component during steel making and refining. The composite is applied by discharging a carrier gas containing a mixture of small particles, including particles of silica, particles of at least one high-temperature oxide based material and particles of solid carbonaceous fuel, through a carrier gas discharge nozzle. Additional substances may be added to the mixture to enhance the slag-forming process. A controllable flow of oxidizing gas is charged at high and preferably supersonic speed through an essentially crescent-shaped nozzle partially surrounding the carrier gas discharge nozzle. The carbonaceous fuel is ignited and rapidly burned, causing silica based material to become fluid and to coat the high-temperature oxide particles, thereby enhancing the adhering properties of said hot particles and facilitating the reaction of high-temperature oxide with the silica. The resulting hot gaseous mixture and hot particles are impacted on the refractory wall, where at least some of the hot particles adhere. By controlling the flow of oxidizable gas, the supply of fuel, or both, the amount of solid carbon in the composite applied to the refractory wall, and hence, the porosity of the deposit, is controlled.

31 Claims, 5 Drawing Sheets

METHOD AND APPARATUS FOR FLAME GUNNING

BACKGROUND OF THE INVENTION

1. Field of the Invention

This invention relates to a method and apparatus for flame gunning and more particularly to a method and apparatus for applying hot composite on top of the refractory lining of steel making and processing vessels, wherein said hot composite is periodically applied in order to maintain the desired shape of the refractory lining and to be consumed as a slag forming component during steel making and refining.

2. Description of the Prior Art

Flame gunning was first used with MgO powder for the sole purpose of hot refractory repair in the U.S.S.R. more than 15 years ago, primarily for basic oxygen furnaces (BOF). Later on, modifications of these flame gunning methods and apparatuses were made and used around the world. But in spite of such widely available knowledge about flame gunning, the practical use of this technology today is limited. Such limited use is a result of the additional expense and complexity of the flame gunning method of applying MgO powder in comparison with the relatively simple wet gunning of MgO powder, which provides similar longevity of the repaired refractory layer. In both cases, expensive MgO powder is applied only to restore the shape and thermal insulating characteristics of refractory lining and also for the prevention of refractory consumption by aggressive slag. To reduce the cost of the refractory lining, the use of burnt lime has been proposed in several Soviet Certificates of Inventions. Originally, the use of lime was proposed as a partial substitution for MgO (AC# 676579 U.S.S.R.). Later on, the use of lime with no MgO powder was suggested. In all of these cases, the use of solid carbonaceous, liquid or gaseous fuel and oxygen-rich oxidizing gas (typically pure oxygen) has been suggested to create a high temperature flame, which is used to heat refractory materials to a temperature exceeding the softening temperature of MgO positioned inside of the flame directed toward the refractory lining. When coke was added to the flame gunning mix as a fuel, a deposit layer having substantial porosity and containing unburned solid carbon was formed due to the inability of existing flame gunning systems to completely convert solid carbon into CO and $CO_2$. The porosity of the deposit layer is caused by the oxidation of the deposited carbon to CO inside the deposit layer.

All of the above-described gunning mixtures were designed to provide conversion of MgO and dolomite clinker into plastic form inside of the flame envelope directed toward the hot refractory wall. Conversion of these refractory materials into plastic form at high temperature is required in order to produce a deposit layer of gunned material by striking this material against the wall. No requirement for any additional binding components has been suggested or identified in the above Certificates of Inventions.

Various designs of flame gunning apparatus were proposed to provide for the use of gaseous fuel, for example natural gas, to avoid depositing solid carbon in the layer to reduce its porosity. Unfortunately, the use of gaseous fuel results in reduction of the rate of heat transfer from the flame to the refractory wall, leading to rapid cooling of the first portion of the deposit layer contacting the relatively cold refractory wall surface.

Rapid cooling diminishes the adhesive strength between the refractory lining and the gunned layer.

The main purpose of the gunning apparatus using the above-described gunning mix (containing mainly MgO powder) was to apply this mix in such a way that mechanical binding between the hot, softened plastic powder and the rough surface of the refractory wall would allow patching of local wear of refractory walls and to prolong the life of the furnaces without stopping the operation for refractory brick relining.

Later, the idea to use lime as a refractory component of the gunning mix arose from the well known practice of applying slag-forming materials to protect refractory walls without flame gunning. (O. N. Chemesis et al. *Chernaya Metallurgia, Bulletin, ITI* N22:51–52, 1974). Substitution of MgO based flame gunning material with slag forming lime-based flame gunning material was suggested to reduce the cost of the gunning mixture, but was not successfully implemented due to the low longevity of gunned lime-based deposits. This low longevity is caused by insufficient binding strength. The use of more than 5, but less than 10% of blast furnace slag containing 35–40% of $SiO_2$ (i.e., a total content of between 1.75% and 4% $SiO_2$) has been suggested (A.C. #935497, U.S.S.R.) to provide a fused silica-based, low melting and fluidizing temperature binding additive to the flame gunning mixture to be used with conventional flame gunning machines. The use of 5% or less of this binding additive (providing 1.75% to 2% $SiO_2$ by weight of the gunning mixture) was considered undesirable due to diminished binding strength of a gunned deposit having an insufficient presence of $SiO_2$. The use of more than 10% of such binding additive (providing more than 3.5 to 4% $SiO_2$ of the gunning mixture) was also considered undesirable due to an excessive reduction in the melting temperature of the gunned deposit.

Existing flame gunning apparatus designs cannot simultaneously provide sufficient kinetic energy and temperature for the hot gunned mixture impacting the refractory lining. This prevents a successful utilization of the above-suggested flame gunning mixture and leads to as high as a 5–10% carry-over of unbound lime dust into the air pollution control system, thereby rapidly diminishing its performance. The complete surrounding of the carrier gas stream with the oxidizer stream in existing flame gunning apparatuses helps to reduce loss of the gunning mixture from the flame but leads to delayed ignition of the oxygen and carbonaceous fuel mixture. This delayed ignition results in a reduced time available for heating of the flame gunning mixture and for oxidation of solid carbonaceous fuel inside the flame. This insufficient oxidation of carbonaceous fuel together with the limited heat transfer inside the flame envelope causes a continuous presence of substantial amounts of unburned carbon inside the deposit layer. This leads to formation of a highly porous gunned layer because of the subsequent oxidation of the deposited carbon into CO gas.

Thus, existing pyroplastic flame gunning technologies limit the melting of silica based binding additives inside the flame envelope during the flame gunning process, limiting the reaction of fused silica based components with lime particles inside of the flame envelope, which, in turn, limits the total amount of binding additives that can be used without causing excessive fluidity of the deposit layer due to excessive presence of undissolved fused silica in this layer. This necessity to limit the amount of silica based components and the insufficient high-temperature reaction time available inside the flame results in reduced density of the initially formed intermediate or transitional layer, which is the layer responsible for the adhesive strength between the main gunned deposit and the refractory lining. The substantial presence of unburned solid carbon in the intermediate deposit layer further reduces adhesive strength due to an increase in the porosity of the deposit layer. Insufficient velocity and kinetic energy of the hot gunning material impacting the refractor wall also contributes to the high porosity of the intermediate layer produced by conventional flame gunning apparatuses.

SUMMARY OF INVENTION

The present invention provides for processes and apparatuses for flame gunning that are designed to accomplish the rapid and efficient depositing, on the surface of refractory walls, of a consumable, variable-density layer of slag-forming material capable of participating efficiently in the process of slag forming by partially dissolving itself during the metallurgical cycle to be later conducted in the vessel. At the same time, a portion of this consumable layer is used to patch a worn portion of refractory lining and to protect the brick surface of the refractory lining in order to maintain the desired shape of the metallurgical vessel. This flame gunning method is based on a pyroliquid process of forming a refractory deposit layer according to a flame gunning process comprising the following steps:

(a) supplying a controllable flow of a carrier gas containing a mixture of small particles to a mixture discharging channel of a flame gunning lance, the mixture of small particles comprising $SiO_2$, solid carbonaceous material and at least one high-temperature oxide;

(b) supplying a controllable flow of oxidizing gas containing at least 30% oxygen to an oxidizing gas discharging channel having an outlet adapted to partially surround the carrier gas expelled from the mixture discharging channel with the oxidizing gas discharged from the oxidizing gas discharging channel;

(c) discharging the carrier gas flow and the oxidizing gas flow simultaneously through their respective discharging channels towards the hot refractory wall, wherein the oxidizing gas is discharged at a high velocity thereby causing rapid aspiration of an amount of the hot gaseous atmosphere into the carrier gas through at least one gap in the oxidizing gas flow around the carrier gas flow near and downstream of the outlet, thereby rapidly heating to ignition temperature and igniting at least a portion of the carbonaceous fuel in the discharged carrier gas;

(d) controlling the flows of the oxidizing gas and the carrier gas to provide for rapid expansion of the discharged flow of oxidizing gas, thereby causing an essentially complete surrounding of the discharged flow of carrier gas, at least where the carrier gas and the high-temperature oxide particles strike the wall;

wherein hot combustion gasses generated by oxidation of the carbonaceous fuel expand primarily in the direction of discharge of the oxidizing gas, thereby accelerating the discharged flow of carrier gas, vigorously mixing the small particles, and imparting a high velocity and kinetic energy to the high-temperature oxide particles;

and wherein the adhesive strength and porosity of the resulting refractory deposit layer can be controlled and the level of oxidation of the solid carbonaceous fuel can be adjusted.

The carrier gas is preferably inert (e.g., $N_2$); alternately, a carrier gas may be selected to play a role as either a fuel (e.g., by including or comprising a gaseous fuel) or a weak oxidizer (such as compressed air or a mixture comprised of air and $N_2$). The carrier gas supplies a gunning mixture which preferably comprises between 5% and 25% by weight solid carbonaceous fuel; up to 75% but preferably between 40% and 75% of high-temperature oxides (i.e., oxides having a melting temperature of at least about 1500° C. or preferably more than about 1700° C.) which may consist of or be comprised of lime (burnt and/or dolomitic) and also comprising a silica-based binding material (having a melting temperature less than about 1500° C.) in an amount such that the total $SiO_2$ content in the gunning mixture is at least about 5% but less than 20%. Preferably, the total $SiO_2$ content should be at least about 7%, or more preferably at least about 9%.

Even when the carrier gas itself comprises a fuel, it is important that solid carbon comprise at least 5% by weight of the preferred gunning mixture. The gunning mix may also include additional oxidizable solids other than carbon. The preferred gunning mixture may also include other metallurgically active components which can be used to improve the performance of the metallurgical process by consuming the gunned deposit during the metallurgical cycle.

Rapid and early delivery of $O_2$ to the surface of carbonaceous and oxidizable materials is carried out inside the flame envelope adjacent to the output nozzle of the flame gunning lance. To rapidly heat lime and/or other refractory particles and to produce the fluid fused-silica based phase as early as possible, the ignition of carbonaceous fuel takes place much earlier than in previously known systems and mixing of involved solid particles and gases inside the flame envelope takes place very vigorously in the flame produced by the new flame gunning system. This maximizes the time available inside the flame envelope for the coating of hot lime and/or other refractory particles with liquid fused silica and silica-based material for reactions therebetween and also intensifies the delivery of oxygen to the carbonaceous fuel particles so that essentially complete conversion of solid carbon to (at least) CO is accomplished inside of the flame envelope. Since the level of completion of carbon oxidation correlates with the density and porosity of the deposit formed during the flame gunning, an initial high-density layer of refractory material may thus be applied to the wall of the vessel. This dense layer is desirable to maximize binding strength between the deposit and the vessel wall, and may either be the only deposit layer or the base of a multi-layer or variable-density deposit.

When this invention is used for the repair of a steel making furnace lining covered with a layer of solidified slag having entrapped ferrous metal and a lower melting temperature than the refractory lining or gunned deposit, this slag can be used as the initial binding material to provide for an improved binding of the gunned material with the refractory wall. To enhance heat delivery in such cases, excess oxygen (above that needed for complete combustion of oxidizable materials in the flame mixture) is preferably introduced into the flame being generated by the flame gunning apparatus. This excess oxygen is initially heated inside the flame envelope and is later used to oxidize the oxidizable entrapped metallic components contained in the steelmaking slag.

A porous consumable outer layer for slag retaining during steelmaking is desirable in many cases. Because the density and porosity of the deposit formed during flame gunning is correlated with the level of completion of carbon oxidation, such an outer layer can be formed on top of a higher-density gunned layer by reducing the ratio of oxidizing gas to carbonaceous fuel below stoichiometric to provide for the presence of solid carbon in the hot mixture reaching the refractory wall. Alternately, the porous layer can be formed by reducing the flame temperature by adding substantial amounts of a ballast gas.

Accordingly, it is an object of this invention to successfully form a high quality refractory deposit by the flame gunning system which simultaneously provides for a) a flame gunning process capable of essentially complete oxidation of solid carbon to CO and $CO_2$ prior to the moment when gunned material reaches the refractory lining, b) a high heating rate of refractory components inside of flame envelope to ensure an adequate presence of hot fluid binding components inside the flame envelope, c) an active mixing of the fluid binding components inside the flame envelope with the refractory particles of the gunning mixture having a higher melting point in order to provide a preliminary coating of the refractory particles with a fluid binding material containing $SiO_2$ in amounts preferably exceeding 5% of the total weight of the flame gunning mixture, d) an adequate heat delivery to the gunned refractory surface to prevent rapid cooling and solidification of fluid components while contacting colder refractory wall, and e) an adequate velocity and, therefore, kinetic momentum of the gunned material impacting the refractory wall.

Another objective of this invention is to provide a flame gunning method and apparatus capable of applying a gunned deposit layer of variable density.

Another object of the invention is to provide a flame gunning method and apparatus capable of using the further oxidation of metallic oxides, the oxidation of metallic carbides, and oxidation of metallics and other non-carbonaceous oxidizable materials to release and utilize additional heat more rapidly and efficiently inside the flame envelope and on the surface of gunned refractory walls.

Another object of the invention is to provide an improved flame gunning mixture that may be used in a flame gunning apparatus.

A still further object of the invention is to provide a nozzle for a flame gunning apparatus that enhances the rapid aspirating of high-temperature furnace atmosphere into the stream of a carrier gas.

Another object of the invention is to provide a nozzle for a flame gunning apparatus that can provide for the essentially complete surrounding of the carrier gas by the oxidizing gas at or before the point at which the discharged particles from the nozzle strikes the wall of the vessel.

Another object of the invention is to provide a lining for walls of refractory vessels that comprise a dense inner layer and a porous, consumable outer later, the inner layer providing for enhanced adhesion of the lining and the outer layer being capable of enhancing the slag-forming process.

A still further object of the invention is to provide a method of controlling the temperature of a flame suitable for use in a flame gunning apparatus.

These and further objects of this invention will be more completely disclosed and described in the following specification, the accompanying drawings, and the appended claims.

DESCRIPTION OF THE PREFERRED EMBODIMENTS

Figure 1:
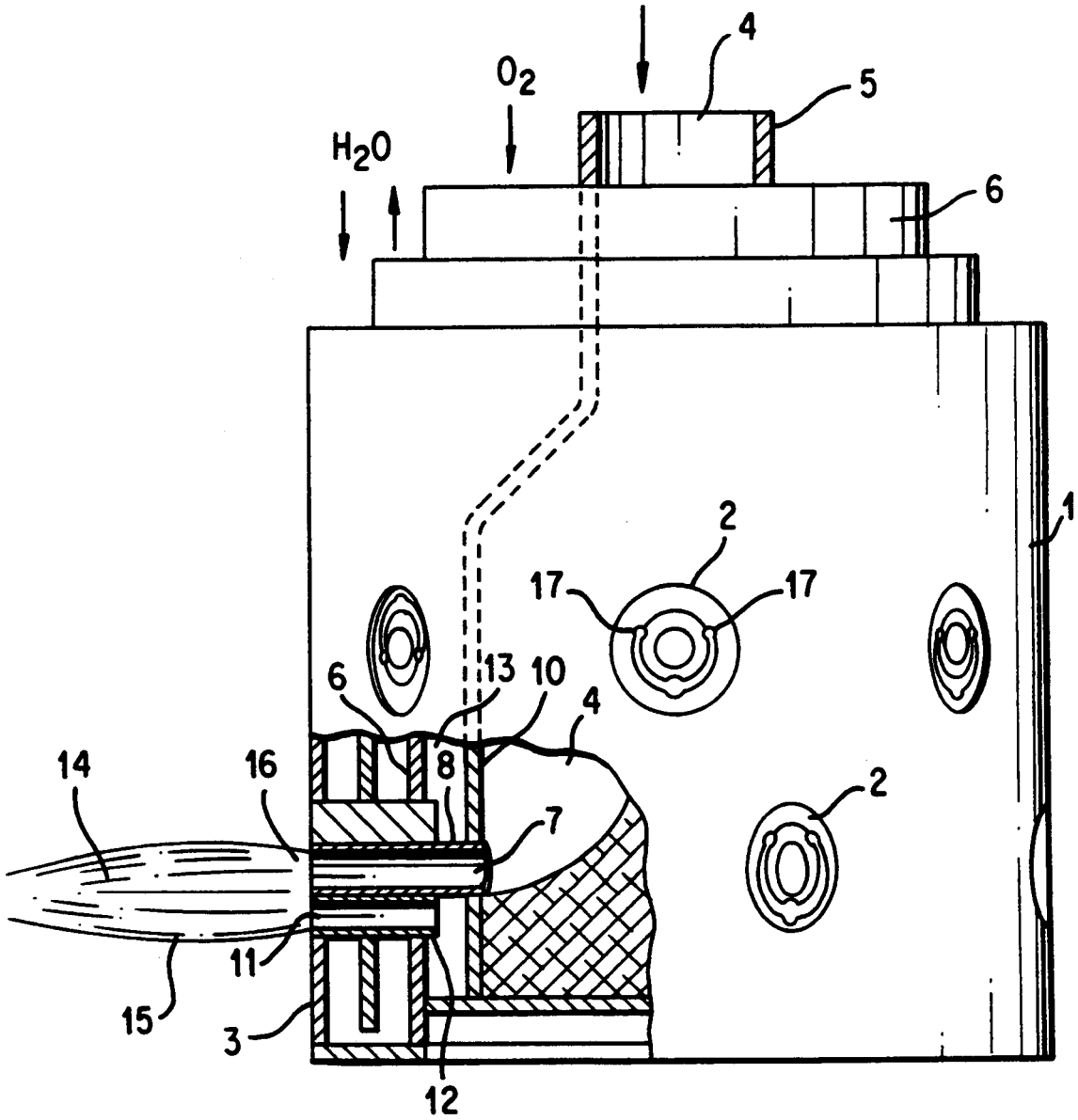
FIG. 1 shows the tip portion of a flame gunning lance in accordance with the invention with multiple nozzles.

The first preferred embodiment of a flame gunning lance is shown in FIG. 1. This first preferred embodiment is designed to provide multiple flame envelopes produced by a water cooled flame gunning lance 1 via multiple nozzles 2. It will be understood that, although multiple nozzles 2 are illustrated in the preferred embodiment, a single nozzle could also be used. The lance comprises an outer water cooled shell 3, a central channel 4 located inside a conduit 5 for supplying the flame gunning mixture carried by the stream of carrier gas to the multiple nozzles 2. Nitrogen, natural gas, compressed air, or another gas or mixture of gases can be used as a carrier gas to carry the flame gunning mixture. The carrier gas should preferably be dry to prevent agglomeration and reaction of the hygroscopic component of the mixture. It is possible for the carrier gas to play an additional role as fuel or oxidizer in the flame gunning process.

The flame gunning mixture carried by the stream of carrier gas is preferably a mixture of between 5% to 25% by weight of carbon and hydrocarbons to be used as a fuel; up to 75% but preferably between 40% and 75% by weight lime (burnt and/or dolomitic); and a silica-based binding material having a melting temperature less than 1500° C. in an amount such that the total $SiO_2$ content in the gunning mixture (including the ash content of the fuel) is at least 5% and preferably more than 7% but no more than 20%. It is important that the total amount of solid carbon in the preferred gunning mixture be at least 5% of the total mixture.

The gunning mixture may also include other metallurgically active components, which are used to improve the performance of the metallurgical process when the gunned deposit is partially consumed for slag-forming purposes during the metallurgical cycle. For example, the addition of MnO and $Al_2O_3$ to the gunning mix will improve the sulfur refining capability of the slag.

The gunning mixture may also include additional solid fuel that does not contain carbon or hydrocarbons. Such fuel may be comprised of oxidizable materials such as Al, Fe, FeO, MnO, FeSi, FeMn, SiC and others which exist separately or are partially or completely fused with $SiO_2$, silica-based binding materials, and/or other components. The specific chemistry of these components allows them to be oxidized to release heat that is used very effectively to melt and to overheat itself and other components of the mixture inside the flame envelope to a very high temperature above the melting point, while they are themselves converted by oxidation into metallurgy enhancing components prior to reaching the gunned refractory walls.

A broad variety of carbonaceous materials can be used as fuel, preferably including coal which has a high content of silica-based ash. The creation of low melting temperature silica-based ash formed during oxidation from such fuel sources inside the flame envelope prior to impinging the refractory lining is desirable because it dissolves or assists in the dissolving of both the original refractory lining and the major refractory component of the gunning mixture upon reaching high temperature. The use of carbonaceous fuel having substantial amounts of hydrocarbons is desirable to accelerate ignition and improve heat distribution inside the flame envelope. The use of coke powder with a low silica based ash content and a low percentage of volatile hydrocarbons is possible, but much less desirable.

Oxidizing gas (such as oxygen, oxygen-enriched air or any other oxygen-rich oxidizing gas containing at least 30% and preferably more than 35% oxygen which can be used as a gaseous oxidizer) is supplied to the multiple nozzles 2 via an oxidizing gas supply channel 13 formed between the outside wall of conduit 5 and a surrounding wall 6.

The multiple outlet channels 7 communicating with the central channel 4 are used to introduce gunning mixture toward the metallurgical vessel interior. These outlet channels 7 are formed inside conduits 8 which are connected to a wall 10 of the larger diameter bottom section conduit 4 located near and upstream of the points of connection of channel 4 with multiple channels 7.

Figure 2B:
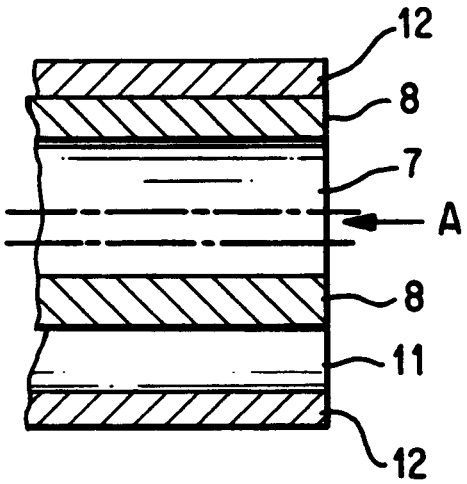
FIGS. 2(*a*) and (*b*) show a front and side view, respectively, of a first embodiment of a nozzle.
Figure 2A:
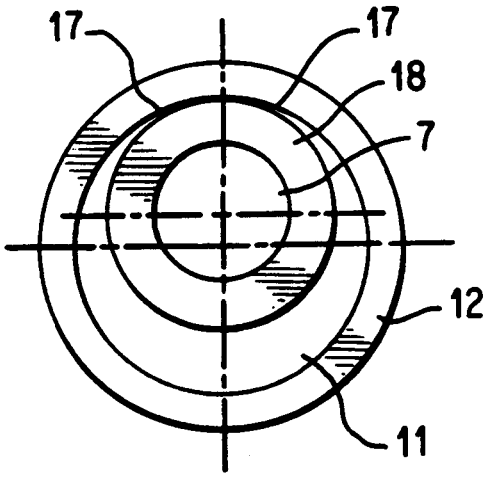
Figure 4B:
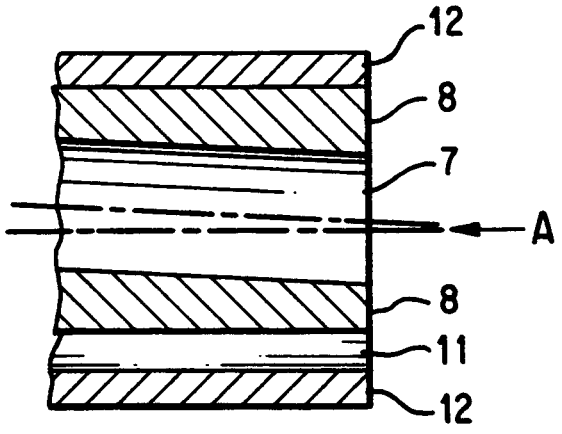
FIGS. 4 (*a*) and (*b*) show a front and side view, respectively, of a third embodiment of a nozzle.
Figure 4A:
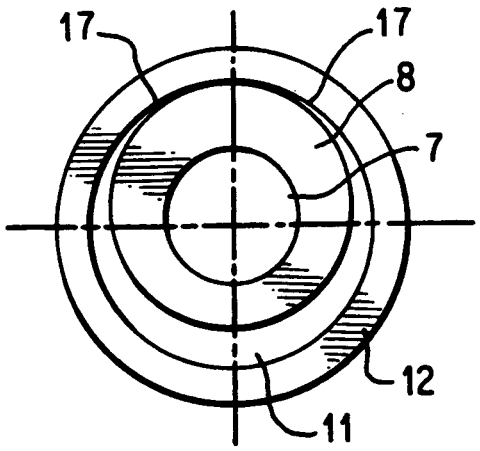

The flame gunning lance further comprises multiple oxygen outlet channels 11 located in communicating relationship with oxygen supply channel 13. These multiple channels 11 are formed between the outside surface of conduits 8 and the inside surface of conduits 12 being permanently connected to wall 6. Preferably, these channels 11 have an essentially crescent cross-section as shown in FIG. 2(*a*) and (*b*) and are circularly shaped conduits. Pipes or tube pieces may be used with or without additional mechanical machining depending on the desired shape and dimensions of channels 11. The streams of gasses are discharged from channels 7 and 11 in an essentially parallel directions. However, the discharges may be converging rather than parallel, as shown in the nozzle embodiment of FIGS. 4(*a*) and (*b*). The convergence of the streams out of a nozzle having converging rather than parallel jets, such as in FIGS. 4(*a*) and (*b*) provides for better mixing of the carrier gas and the oxidizing gas streams.

The desirable shape of channel 11 can provide for the formation of high impulse supersonic essentially crescent-shaped jets carrying a high pressure stream of oxidizing gas to be discharged throughout these channels toward the furnace atmosphere. These essentially crescent-shaped jets of oxidizing gas have such a structure that the outer oxygen streams can be directed toward the wall to be gunned with high velocity, preferably supersonic speed. (The carrier gas jet containing the gunning mixture is preferably not discharged at such high speeds.) The shape of these jets provide for the initial enclosing of more than 50% but less than 90% of the perimeter of each internal stream 14 carrying gunning mixture being discharged via outlet channels 7. The high aspirating capability of preferably supersonic oxidizing gas jets 15 discharged through the channels 11 is used to rapidly aspirate the hot furnace atmosphere into the gunning mixture stream 14. The hot furnace atmosphere is aspirated into the flame gunning mixture stream 14 through a gap 16 in the oxidizing gas stream 15 formed with the gap between two ends 17 of the crescent. This hot atmosphere is later utilized to preheat carbonaceous fuel particles very rapidly to the temperature needed for ignition of hydrocarbons volatilized from these particles and later carbonaceous particles itself with streams of rich oxidizing gas (for example, pure oxygen) being discharged throughout channels 11. After the oxidizing gas streams are discharged throughout channels 11, the streams are expanded continuously so that the distance between the two ends of the crescent is continuously reducing. Thus, the gunned mixture becomes increasingly surrounded by the oxidizing gas.

The dimensions of these crescent shaped channels 11 may have different cross-sections and may readily be selected to provide the desired high velocity of the oxidizing gas streams and to provide the capability of these streams to change their shape along the way to the targeted surface. The shape and dimensions of these channels provide for the essentially complete surrounding (>90%) of the gunned mixture with the oxidizing gas stream in a distance equal to less than one-half of the distance between the outlet of the channels 11 and the targeted refractory wall of the vessel. (In operation, the flame gunning apparatus would be positioned so that the latter distance is between about 2 to 20 feet [depending on the size of the vessel], so that the flame from the apparatus would strike the walls of the vessel.) After such essentially complete surrounding takes place, these oxidizing gas streams still have velocity in the direction of gunning equal to at least 40% of sonic velocity. The required dimensions, which may readily be discovered by experimentation, vary with throughput requirements, the dimensions of the flame gunning apparatus, and the distance between the apparatus and the wall.

It will be readily understood that the crescent-shaped supersonic oxidizing jets will draw in the hot atmosphere of the furnace, causing the gunning mixture to ignite. It is preferable that the open part of the crescent be on the top rather than on the bottom, because the particles in the gunning mixture surrounded by the crescent-shaped jets will be better supported, allowing less of the gunning mixture to drop out of the flame before it hits the walls of the vessels or is burned to gaseous $CO_2$.

Solid particles of lime traveling through the flame will be heated by the transfer of heat from surrounding gaseous combustion products and by radiation from the hotter particles of burning coal and other oxidizable materials which are undergoing exothermal oxidation reactions inside the flame envelope.

The use of different silica containing materials including slags and dust from several metallurgical processes can be recommended as a source of silica based binding material. The use of slags generated from the production of pig iron, steel, ferroalloys, and aluminum can be recommended because they comprise some metallic oxidizable materials and metallurgy enhancing components. Dust containing metallic Fe, Mn, Al or their oxides can also be recommended as metallurgy enhancing components.

Carbonaceous and other oxidizable materials forming low melting temperature ash should be used in the gunning mixture to enhance the formation of a well-dispersed molten phase inside the flame envelope. Rapid and early delivery of $O_2$ to the surface of carbonaceous and oxidizable materials is carried out the flame envelope adjacent to the output nozzle of the flame gunning lance to rapidly heat silica-based particles and to produce the fluid-fused silica based phase as early as possible. The vigorous mixing of the involved solid particles and gases inside the flame envelope maximizes the time available inside the flame envelope for the coating of hot lime particles with liquid fused silica and/or other oxide particles for reactions therebetween, and also intensifies the delivery of oxygen to the carbonaceous fuel particles so that essentially complete conversion of solid carbon to (at least) CO is accomplished inside the flame envelope.

Figure 3B:
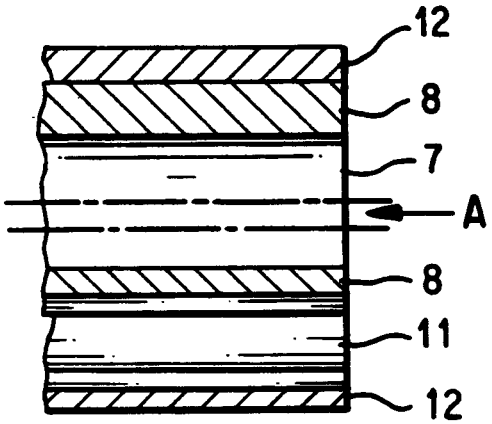
FIGS. 3(*a*) and (*b*) show a front and side view, respectively, of a second embodiment of a nozzle.
Figure 3A:
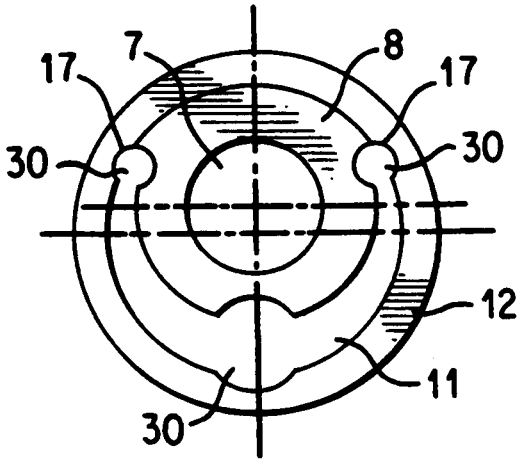

The modified horseshoe shape of the oxygen channel 11 shown in FIGS. 3(*a*) and (*b*) provides for better stability of the oxygen jet along the way from the outlet of channel 11 to the refractory walls of the metallurgical vessel. The use of a horseshoe-shaped channel 11 also provides for better stability of the oxidizing gas jets and a higher final velocity of the streams impinging the surface of the gunned refractory lining. In addition, circular regions 30 may be formed in the channel 11 to produce stabilizing streams in the supersonic or subsonic jets emerging from the channel 11. These stabilizing streams prevent the formation of undesired stream pulsations.

Figure 5B:
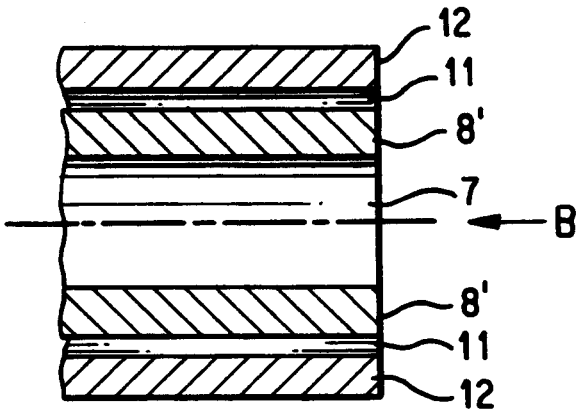
FIGS. 5(*a*) and (*b*) show a front and side view, respectively, of a fourth embodiment of a nozzle.
Figure 5A:
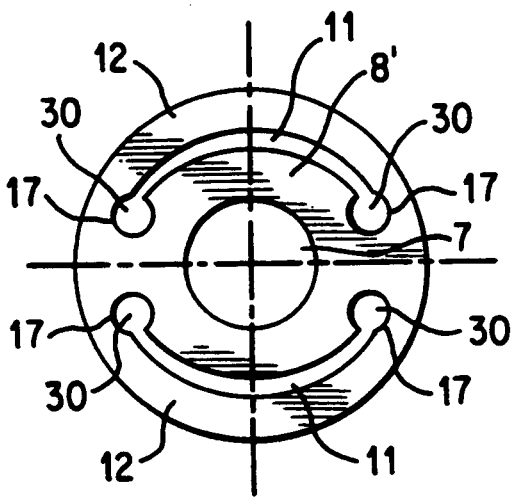

An alternate nozzle can be formed as in FIGS. 5(*a*) and (*b*). As can be seen in these figures, the channel 7 is surrounded by a pair of channels 11, which are preferably above and below channel 7. This type of nozzle forms an oxidizing gas stream with more even distribution of oxidizing gas surrounding the carrier gas jet discharged from channel 7 to provide for better uniformity of oxidation of the flame gunning mixture. The aspiration of the hot atmosphere occurs in two places in this nozzle embodiment, because there are two gaps in the surrounding of channel 7 by the pair of channels 11. In this type of nozzle, region 8' separating the channels 11 from the channel 7 may be integrally formed with the conduits 12.

Figure 6:
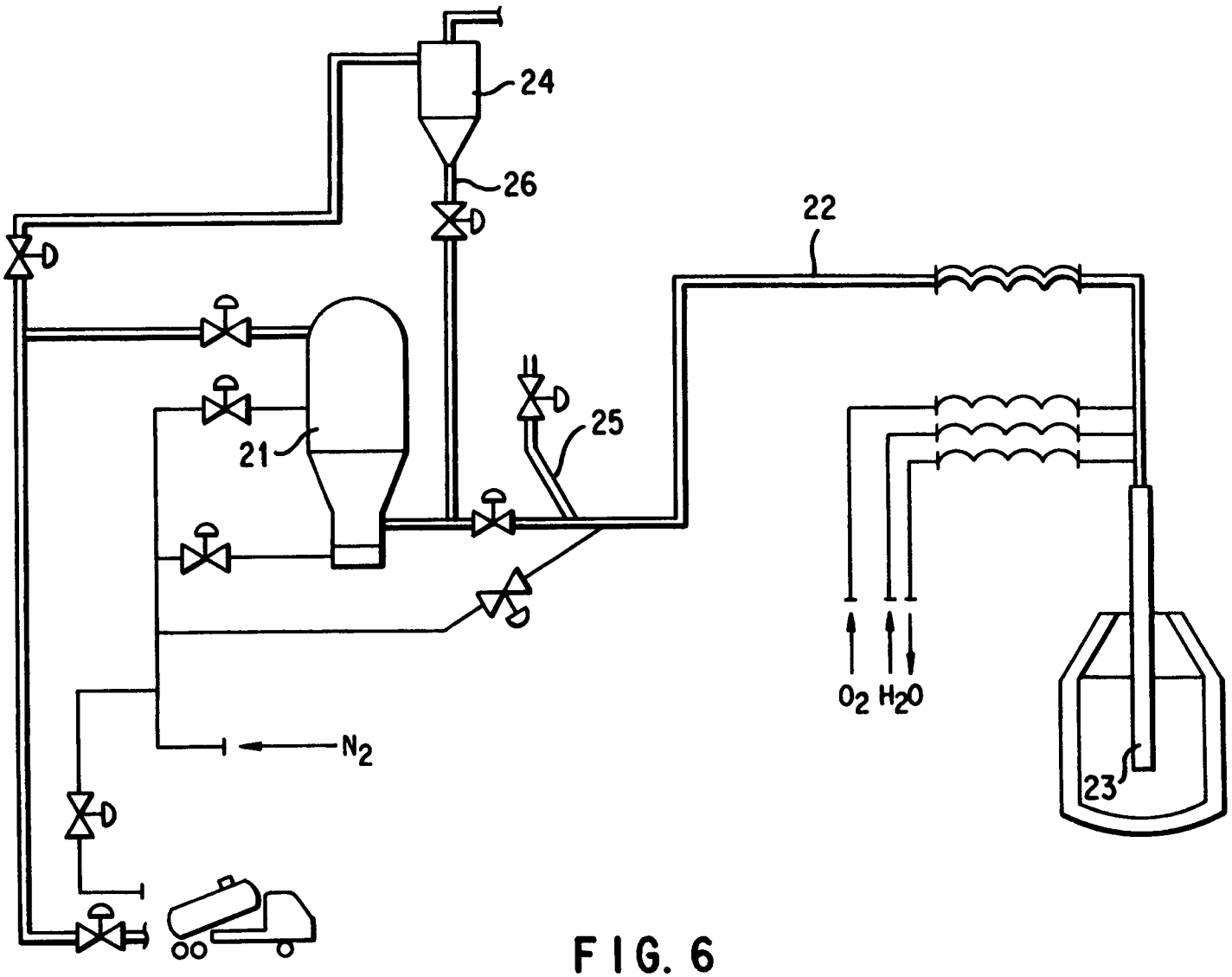
FIG. 6 shows a general schematic of a flame gunning system in accordance with the invention.

An embodiment of the invention used to apply the flame gunning mixture to a basic oxygen furnace vessel may be operated by supplying the flame gunning mixture from a flame gunning mixture feeder 21 shown in FIG. 6 to a movable flame gunning lance 23 via conduit 22.

The feeder 21 is pressurized with nitrogen or another carrier gas. The lance 23 is water-cooled and may be designed to be moved into a vessel positioned horizontally or vertically. The flame gunning system preferably includes an electrical system for mass flow control (not shown in FIG. 6) of the flame gunning mix, the oxidizing gas and the carrier gas. The lance movement may be automated or controlled by the furnace operator. An additional smaller feeder 24 is preferably used to supply the carbonaceous fuel materials (which may optionally include additional oxidizable and/or $SiO_2$ containing materials) to the conduit 22 from branch conduit 26 during vessel preheating mode. When vessel preheating is carried out, the supply of flame gunning mix from feeder 21 is terminated and the flame gunning apparatus operates with solid materials solely supplied from feeder 24.

During preheating mode, the mass flow of solid particles supplied through central channel 4 of lance 23 is substantially less than during lance operation with flame gunning mix. During the preheating cycle the velocity of the oxygen jets introduced via multiple channels 11 is preferably maintained at close to supersonic. The velocity of the carrier gas jets is preferably kept 5–20 times below the velocity of oxygen jets.

The mass ratio of oxygen to carbonaceous material should preferably be kept less than stoichiometric during preheating mode to prevent excessive oxidation of the lining material when flame gunning is used with a furnace lined with carbon-bearing refractory lining. When the walls of the vessel are already coated with a previously gunned deposit and BOF slag is retained on the wall from the previous heat, the ratio of oxygen to fuel should be kept preferably above stoichiometric to allow the excess mass of oxygen to react with the oxidizable components of retained slag such as FeO by converting it to $Fe_2O_3$ in order to release heat and to speed up the heating of the wall surface. The temperature and velocity of the impinging jets containing hot liquid silicate ash created by combustion of carbonaceous fuel should be kept high enough to provide for good contact of silicate ash particles and wall surface after impact. This contact is necessary to ensure initial dissolving of the wall surface material with $SiO_2$ during preheating in order to provide high adhesive strength and high density of a transitional layer located between the wall and a flame gunned deposit applied after the preheating cycle. The controllable movement of the lance inside the BOF interior or other metallurgical vessel during the preheating cycle should prevent local overheating but provide for local preheating of areas of the wall, if so desired, prior to flame gunning.

Preheating of BOF and other metallurgical vessels may be conducted prior to the flame gunning cycle when flame gunning is conducted after a delay or when the operator concludes that the BOF walls are too cold around the spot to be gunned. When the operator chooses to use preheating, the preheating cycle should preferably be carried out for 2–3 minutes and prior to the main flame gunning cycle.

To initiate the main flame gunning cycle, the operator should terminate the flow of carbonaceous material in conduit 22 and then direct the flame gunning mix from feeder 21 into conduit 22. It is recommended that oxygen jets be provided via channels 11 such that oxygen, after leaving the channel, develops a velocity about 1.2–1.3 times above sonic during the first 1.5–2.5 minutes of main gunning when the transitional layer is being formed. A flame gunning mixture velocity 5–10 times below sonic is provided via channels 7 during this initial period. The ratio of oxygen to carbonaceous materials should be kept preferably above stoichiometric to provide for essentially complete conversion of carbonaceous fuel into CO and $CO_2$. It is important to understand that incomplete combustion of carbon to gaseous CO is adequate to prevent the presence of carbonaceous materials inside the gunned deposit. The major part of post-combustion of CO to $CO_2$ should preferably take place inside the flame envelopes to ensure the necessary heat release and an adequately high temperature of the gunned material prior to its impact with the wall surface.

Figure 7:
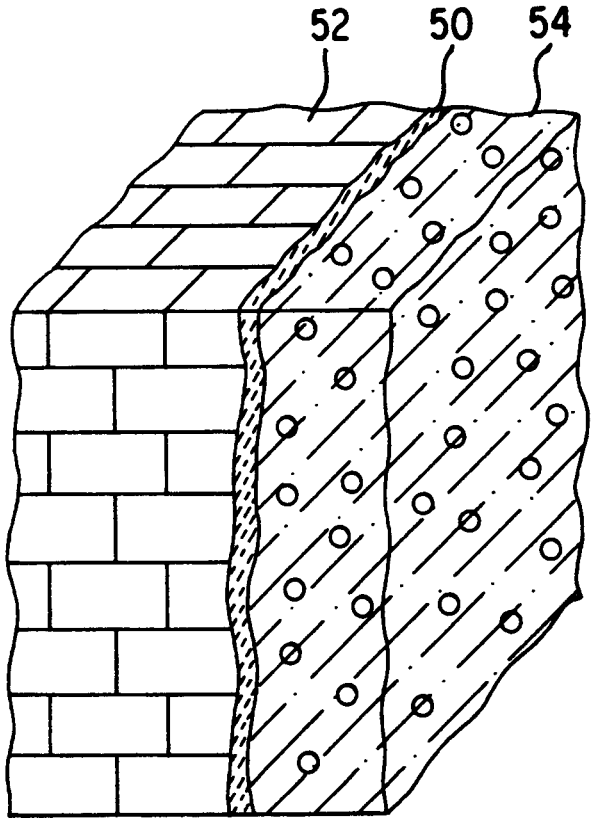
FIG. 7 shows a multilayer lining over a refractory vessel in accordance with this invention.

The level of completion of carbon oxidation correlates with the density and porosity of deposit formed during flame gunning. When unburned carbonaceous material is present inside the hot deposit, this material continuously reacts with oxides generating gaseous CO which then diffuses throughout the hot deposit layer making this layer porous. Referring to FIG. 7, it is therefore important during the initial formation of a transitional layer 50 (which is responsible for the adhesive strength of the entire deposit) over the wall 52 of the vessel (and any other layers [not shown] that may also be over the wall, such as a carbon-bearing refractory lining or a previously gunned deposit) to maintain oxygen and solid particle velocities and an oxidizer/fuel ratio capable of providing essentially complete conversion of solid carbonaceous components to CO and $CO_2$.

The rate of oxidation of solid carbon is limited because every molecule of $O_2$ must come to the surface of the solid carbon to create CO. (Solid carbon cannot be completely oxidized to $CO_2$ until this CO gas is first formed.) On the other hand, volatile components in the fuel can mix as gasses with oxygen and rapidly complete their oxidation. The use of a carbonaceous fuel like coal having a higher percentage of hydrocarbons and other volatile components is therefore advantageous, because the essentially complete conversion of carbonaceous components to CO and $CO_2$ gasses is more readily accomplished.

Again referring to FIG. 7, a porous consumable outer layer 54 responsible for slag forming during steelmaking can be formed after the transitional layer has been formed. The high porosity outer layer is formed (preferably after the intermediate layer reaches a thickness in excess of one millimeter) by reducing the ratio of oxidizer to carbonaceous fuel (contained in the gunning mixture) below stoichiometric to provide for the presence of solid carbon in the hot mixture reaching the refractory wall during the flame gunning cycle. This ratio reduction may be accomplished by decreasing the oxygen flow and/or by increasing the flame gunning mix flow. The high porosity outer layer may also be formed by reducing the temperature of the flame through the use of substantial amounts of a ballast gas such as nitrogen, (supplied as pure nitrogen or as nitrogen of compressed air). This will lead to incomplete combustion of the carbon and increased porosity of the outer deposit layer. Therefore, the density of the main consumable outer layer can be controlled by controlling the completion of carbon oxidation. This consumable outer layer can be consumed (i.e., its thickness is reduced) and used effectively for slag forming in one or more heats, which would allow for a substantial reduction in the use of cold charge slag forming material (i.e., burnt lime or dolomitic lime) due to the more efficient use of well-preheated gunned material for slag forming.

An additional intermediate sinterring cycle may optionally be conducted to further improve the quality of the transitional layer prior to the application of the main consumable outer layer. This additional sinterring cycle may be accomplished by reducing the flow of gunning mix by one-third to two-thirds for 2–4 minutes after the first transition layer has been formed. The sinterring cycle should superheat the transition layer preferably above 1700° C. prior to applying the main outer layer while pounding this transition layer with a high velocity hot oxidizing combustion product comprising a small volume of the hotter particles of the flame gunning mixture. Optionally, an additional third layer can be formed on top of the consumable outer layer to improve the resistance of the outer layer to excessive wear during steelmaking, by changing the firing mode at the end of the gunning process to increase the oxygen-carbonaceous fuel ratio above stoichiometric. When the flame gunning system of this invention is used for operating in BOF vessels, the system should be capable of applying gunning material with a rate of 0.4–2.5 tons per minute.

Pure oxygen or oxygen enriched air can be used as the oxidizing gas for flame gunning. When oxygen enriched air is used, the ratio of air to pure oxygen can be controlled to vary the flame temperature and the oxidizing gas velocity by controlling the flow of ballast nitrogen provided with the compressed air. During vessel preheating, the control of adiabatic flame temperature can be accomplished by controlling the ratio of oxygen and compressed air. Increasing the compressed air percentage will increase the amount of ballast nitrogen and, therefore, reduce the flame temperature, preventing high temperature thermal shock of the surface being preheated. This increase would also help to maintain the high velocity of the oxidizing gas streams even during the initial substoichiometric preheating cycle in order to improve the kinetic momentum of liquid coal ash impacting the hot refractory wall during the preheating cycle. Inside the flame, as early as possible to allow for preliminary coating, the refractory components such as lime or MgO are essentially coated with hot silicates inside the flame. This preliminary coating is then allowed to achieve a good density, and may have different chemistry than further gunned deposits. An initial interaction between silica and lime-based components inside the flame envelope coats hot lime particles with liquid fused silica-based material prior to impact on refractory wall, so that these particles become more round and adhesive and are thus capable of forming a more dense and better bound deposit layer with the refractory wall. The chemical composition of the gunning mix should not only provide for the presence of said fluid component (preferably based or fused silica) but also to provide for the further sinterring of the applied deposit. This sinterring should take place partially during flame gunning and partially during further operation of the deposit under the high temperature environment of the metallurgical process carried out in gunned vessel. The sinterred deposit should have two essential characteristics: a high melting temperature and a dense, well-bound (both chemically and physically) transition layer formed between refractory lining and the gunned deposit. These two characteristics ensure a high adhesive strength between the refractory lining and the flame gunned layer. The chemical composition of the flame gunned mix should ensure the formation of a consumable outer layer having a high melting point and a controllable density. This consumable outer layer should provide for slag accumulating capability via partial retaining of process slag. This should be accomplished by forming an outer layer of lesser density than the transitional high density layer.

It should thus be readily apparent that the methods and apparatuses disclosed are capable of accomplishing refractory vessel preheating with or without oxidation of material retained on the vessel wall surface and with or without hot fluid ash material formed in the flame by the oxidation of carbonaceous fuel and/or other solid oxidizable material. It is also readily apparent that both refractory vessel preheating and flame gunning can be accomplished while controlling the presence of ballast gas, e.g., nitrogen, in the flame and, therefore, the adiabatic flame temperature.

In addition, the methods and apparatuses described reduce the portion of the flame gunning material lost from the flame envelope, thereby increasing efficiency.

The described preferable design of the flame gunning nozzles allows the use of very high velocity oxidizing gas jets. The velocity of these jets is used to accelerate slower streams of gunning mixture that are initially surrounded by oxygen jets. So, in spite of the gas carrying gunning mixture's low initial velocity, the mixture is significantly accelerated prior to reaching gunned refractory surface. This invention thus provides a high momentum impacting stream of gunned material on the targeted refractory surface. It also provides substantial melting of part of the components being gunned prior to impact on the targeted refractory surface and a substantial change in the adhesive characteristics and shapes of particles having the highest melting point among gunning mix component (such as lime). These changes are due to the coating of these particles in the flame with liquid oxides, thereby lowering their melting temperature and creating a more round shape of refractory particles, accounting for improved characteristics of the deposit layer such as higher density, better adhesive strength and longevity. A thicker deposit is formed in a significantly short time, and a higher porosity of outer layer permits retention of between 5–15% of the metallurgical slag (in the case of the BOF) on the surface being gunned. This leads to substantial recovery of slag forming material and increased metallic yield of the BOF process. Due to the enlarged contacting surface between the hot layer of slag-forming material and molten metal during earlier stage of steelmaking when the initial slag is formed, small additions of slag-enhancing additive provide significant improvements in the initial stage of slag forming. Earlier production of good quality slag increases metallic yield, improves refining capability of the steel making process, reduces the consumption of slag-forming materials, and reduces dust emission from the BOF vessels.

What is claimed is:

1. A method of flame gunning a high-temperature vessel having a hot refractory wall and a hot gaseous atmosphere to form a deposit layer, the method comprising the steps of:

(a) supplying a controllable flow of a carrier gas containing a mixture of small particles to a mixture discharging channel of a flame gunning lance, the mixture of small particles comprising $SiO_2$, solid carbonaceous fuel and at least one high-temperature oxide;

(b) supplying a controllable flow of oxidizing gas containing at least 30% oxygen to an oxidizing gas discharging channel having an outlet adapted to partially surround the carrier gas expelled from the mixture discharging channel with the oxidizing gas discharged from the oxidizing gas discharging channel;

(c) discharging the carrier gas flow and the oxidizing gas flow simultaneously through their respective discharging channels towards the hot refractory wall, wherein the oxidizing gas is discharged at a high velocity thereby causing rapid aspiration of an amount of the hot gaseous atmosphere into the carrier gas through at least one gap in the oxidizing gas flow around the carrier gas flow near and downstream of the outlet, thereby rapidly heating to ignition temperature and igniting at least a portion of the carbonaceous fuel in the discharged carrier gas;

(d) controlling the flows of the oxidizing gas and the carrier gas to provide for rapid expansion of the discharged flow of oxidizing gas, thereby causing an essentially complete surrounding of the discharged flow of carrier gas, at least where the carrier gas and the high-temperature oxide particles strike the wall;

wherein hot combustion gasses generated by oxidation of the carbonaceous fuel expand primarily in the direction of discharge of the oxidizing gas, thereby accelerating the discharged flow of carrier gas, vigorously mixing the small particles, and imparting a high velocity and kinetic energy to the high-temperature oxide particles;

and wherein the adhesive strength and porosity of the resulting refractory deposit layer can be controlled and the level of oxidation of the solid carbonaceous fuel can be adjusted.

2. The method of claim 1, wherein the oxidizing gas discharge channel comprises a crescent-shaped outlet.

3. The method of claim 1, wherein the oxidizing gas discharge channel comprises a horseshoe-shaped outlet.

4. The method of claim 1, 2 or 3 wherein the mixture of small particles comprises between about 5% and about 25% by weight of solid carbonaceous fuel, between about 40% and about 75% by weight high-temperature oxide, and silica-based binding material having a melting temperature less than about 1500° C. such that the total $SiO_2$ content of the mixture is between about 5% and about 20% by weight.

5. The method of claim 4, wherein the total $SiO_2$ content is more than 7% by weight.

6. The method of claim 1, wherein the high-temperature oxide is selected from the group consisting of burnt lime and dolomitic lime, and mixtures thereof.

7. The method of claim 1, wherein the carrier gas comprises additional gaseous fuel.

8. The method of claim 1 wherein the carrier gas comprises an additional oxidizing gas.

9. The method of claim 8 wherein the carrier gas comprises air.

10. The method of claim 8 wherein the carrier gas is comprised of a mixture of air and nitrogen.

11. The method of claim 1 wherein the carrier gas is inert.

12. The method of claim 11 wherein the carrier gas is comprised of nitrogen.

13. The method of claim 2, wherein the dimensions of the crescent-shaped outlet are selected to allow an essentially complete surrounding of the gunned mixture of small particles prior to the high-temperature oxides striking the wall with the flow of oxidizing gas in a distance equal to less than the distance between the outlet of the oxidizing gas nozzle and the hot refractory wall.

14. The method of claim 1 wherein the carbonaceous material comprises $SiO_2$, thereby forming a silica-based low melting temperature ash during oxidation.

15. The method of claim 4 wherein the small particles comprising $SiO_2$ are heated to fusing temperature in the flame and is mixed with heated particles of the high-temperature oxide to form hot, sticky, and essentially round particles $SiO_2$-coated high-temperature oxide.

16. The method of claim 13 wherein the lime particles coated with the fused $SiO_2$ are heated sufficiently inside of the flame to partially dissolve the lime in the fused $SiO_2$.

17. The method of claim 1 wherein the oxidizing gas flow is maintained at a level in excess of stoichiometric level, thereby oxidizing essentially all carbon contained in the solid carbonaceous fuel to at least CO and creating a high density intermediate flamed gunned deposit layer.

18. The method of claim 17 wherein the oxidizing gas flow is reduced below stoichiometric level after the intermediate flame gunned deposit layer reaches a thickness in excess of about one millimeter, thereby causing incomplete combustion of the carbon in the carbonaceous fuel so that part of the incompletely combusted carbon is present in the mixture impacting the hot refractory wall, until a layer of reduced porosity containing solid carbon particles is deposited over the high density intermediate layer.

19. The method of claim 17 wherein the rate of discharge of the small particles in the carrier gas is increased after the intermediate flame gunned deposit layer reaches a thickness in excess of about one millimeter, thereby causing incomplete combustion of the carbon in the carbonaceous fuel so that part of the incompletely combusted carbon is present in the mixture impacting the hot refractory wall, until a layer containing solid carbon particles is deposited over the high density intermediate layer.

20. The method of claim 1, 2, or 3 wherein the mixture of small particles further comprises at least one additional high-temperature oxide.

21. The method of claim 1 wherein the mixture of small particles comprises at least one additional oxidizable component.

22. The method of claim 1 wherein the oxidizing gas flow and the carrier gas flow are discharged in essentially parallel directions.

23. The method of claim 17 wherein the oxidizing gas comprises a mixture of air and an additional oxygen-rich oxidizing gas, and the proportion of air in the oxidizing gas is increased after the intermediate flame gunned deposit layer reaches a thickness in excess of about one millimeter, thereby reducing the temperature of the hot gaseous mixture impacting the hot refractory wall.

24. The method of claim 21 wherein the additional oxidizable component is selected to release heat during oxidization and to enhance the refining capability of steelmaking slag after being oxidized.

25. The method of claim 18, 19, 23, or 24, wherein said mixture of small particles comprises at least one additional high-temperature oxide.

26. The method of claim 18, 19, 23, or 24, wherein said mixture of small particles comprises at least one additional oxidizable component.

27. The method of claim 18, 19, 23, or 24, wherein said oxidizing gas and carrier gas streams are discharged in essentially parallel directions.

28. The method of claim 18, 19, 23, or 24, wherein said oxidizing gas and carrier gas streams converge after being discharged.

29. A method of enhancing the formation of slag in a refractory vessel comprising the steps of:

(a) applying a dense flame-gunned deposit layer comprising a mixture of fused silica and high-temperature oxides to a wall of a refractory vessel by providing a supply of materials including fuel and oxidizing gas in a first stoichiometric ratio to a flame gunning lance; and (b) applying a less dense, consumable flame-gunned deposit layer comprising metallurgically active components over the dense layer by altering the stoichiometric ratio of fuel to oxidizing gas supplied to the flame gunning lance.

30. The method of claims claim 1, 2, or 3 wherein the mixture of small particles comprises between about 5% and about 25% by weight of solid carbonaceous fuel, between about 40% and about 75% by weight high-temperature oxide, and silica-based binding material having a melting temperature less than about 1500° C. such that the total $SiO_2$ content of the mixture is between about 5% and about 20% by weight, and wherein the high-temperature oxide is selected from the group consisting of burnt lime and dolomitic lime, and mixtures thereof.

31. The method of claims 1, 2, or 3 wherein the mixture of small particles comprises between about 5% and about 25% by weight of solid carbonaceous fuel, between about 40% and about 75% by weight high-temperature oxide, and silica-based binding material having a melting temperature less than about 1500° C. such that the total $SiO_2$ content of the mixture is between about 5% and about 20% by weight, and wherein the mixture of small particles further comprises at least one additional high-temperature oxide.

* * * * *